United States Patent [19]

Hafner

[11] 4,231,206

[45] Nov. 4, 1980

[54] SIDING STRUCTURE

[76] Inventor: Joseph A. Hafner, 91 Dover Dr., StoneyCreek, Canada

[21] Appl. No.: 968,717

[22] Filed: Dec. 12, 1978

Related U.S. Application Data

[63] Continuation-in-part of Ser. No. 804,192, Jun. 6, 1977, abandoned.

[51] Int. Cl.[2] ..... E04D 1/00

[52] U.S. Cl. ..... 52/529; 52/539; 52/586

[58] Field of Search ..... 52/519, 529, 530, 539, 52/588, 595, 586

[56] References Cited

U.S. PATENT DOCUMENTS

| | | | |
|---|---|---|---|
| 973,622 | 10/1910 | Budd | 52/588 |
| 2,642,968 | 6/1953 | Raush | 52/539 |
| 3,150,464 | 9/1964 | Shmitt | 52/545 |
| 3,817,011 | 6/1974 | Weed | 52/519 |
| 4,122,643 | 10/1978 | Hafner | 52/529 |

FOREIGN PATENT DOCUMENTS

| | | |
|---|---|---|
| 213025 | 1/1961 | Austria . |
| 659446 | 6/1929 | France . |
| 188248 | 12/1936 | Switzerland . |

*Primary Examiner*—James A. Leppink
*Assistant Examiner*—Henry E. Raduazo

[57] ABSTRACT

A construction panel is provided for use with other such panels to build up siding on a building structure. The panel includes similar marginal portions each of which defines a channel and an adjacent tongue which extends outwardly from the channel. The shape of the channel is such that it can receive the tongue of an adjacent panel for assembling panels to build up siding.

7 Claims, 4 Drawing Figures

SIDING STRUCTURE

This application is a continuation-in-part of application Ser. No. 804,192, filed on June 6, 1977 now abandoned.

This invention relates to construction panels of the type used to build up siding and soffits on building structures.

The term "siding" will be used in the following description to include wall coverings, soffits and the like which are made up from panels which interlock with one another at longitudinal marginal portions of the panels. Different visual effects can be obtained by varying the profile, texture and finish of the front surfaces of the panels and in some instances the panels would be perforated to provide ventilation.

In general, siding falls into two types. In a first type the front surfaces of the panels lie substantially in a common plane whereas in a second type a forward part of a marginal portion is exposed giving the siding the appearance of more traditional wood clapboard siding. For the purposes of the present description this first type will be termed "flush siding" and the second type "lap siding."

Construction panels for use in assembling siding are usually of roll formed sheet steel or aluminum construction with painted or coated finishes. However, plastic panels are also available. In general, construction panels of these types are provided both with interlocking arrangements along marginal portions and with structure to permit each panel to be nailed or otherwise attached to a building structure. On assembly a panel is generally first secured on the building using a starter strip and then attached at one of its marginal portions. The next panel is then engaged in this one marginal portion and this next panel is also attached to the building structure by its exposed other marginal portion. The procedure is repeated from panel to panel until the siding is completed.

In prior art panels, the interlock provided along one marginal portion of a construction panel has a different shape from that provided at the other marginal portion. Consequently, once siding has been started, each added panel has a right way up. This can prove to be a disadvantage, particularly if long panels are being assembled in a limited space where it may prove to be extremely inconvenient to have to turn and invert the panel to continue assembly. Also, if it is necessary to cut a panel longitudinally or to make an angle cut when applying panels to a gable end it is unlikely that the offcut would prove to be useful. There can therefore be considerable wastage in some installations. A further disadvantage of prior art panels is that they must be applied working from one side only. This can be a disadvantage particularly in soffit installations and when installing vertical siding on gable ends where symmetry is desirable. Also when commencing from the bottom of a wall it is necessary to use a special starter strip.

The present invention provides construction panels which overcome these disadvantages. Panels are provided for use with other such panels to build up siding on a building structure. The panels include similar marginal portions each of which defines a channel and an adjacent tongue which extends outwardly from the channel. The shape of each channel is such that it can receive one of the tongues of an adjacent panel for assembling these panels to build up siding on the building structure. Also because of the symmetry, no starter strip is needed to commence assembly from the bottom of a wall.

The invention will be better understood with reference to the drawings, in which.

Figure 4:
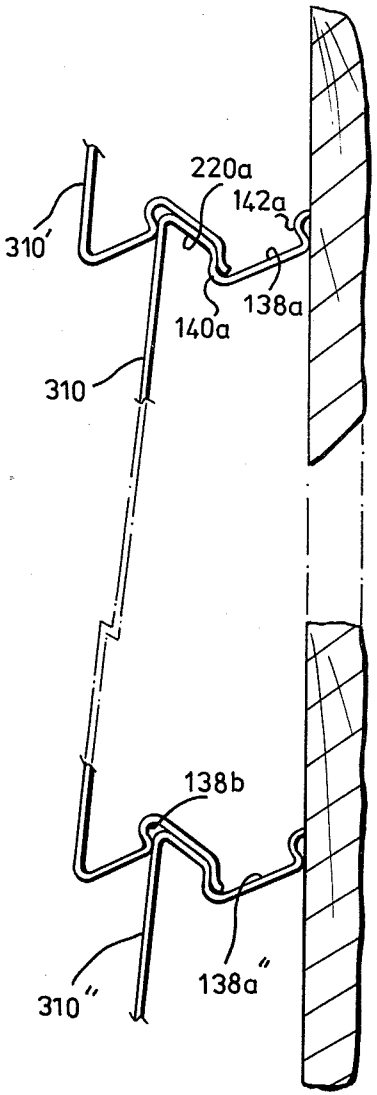
FIG. 4 illustrates yet another embodiment of construction panels according to the invention.

Before describing the embodiments shown in the drawings in detail; it should be noted that the panels have no "right way up" and can therefore be installed from one marginal portion or the other. This is particularly advantageous where a panel is being attached horizontally because if an installer takes the panel to the building structure he does not have to worry about whether or not it is upside down. In many instances the space between buildings would make it difficult to turn and invert a long panel and consequently this structure has a major advantage in this respect. Also the panel allows an installer to start anywhere and to work away from the first panel in both directions when installing flush siding.

Figure 1:
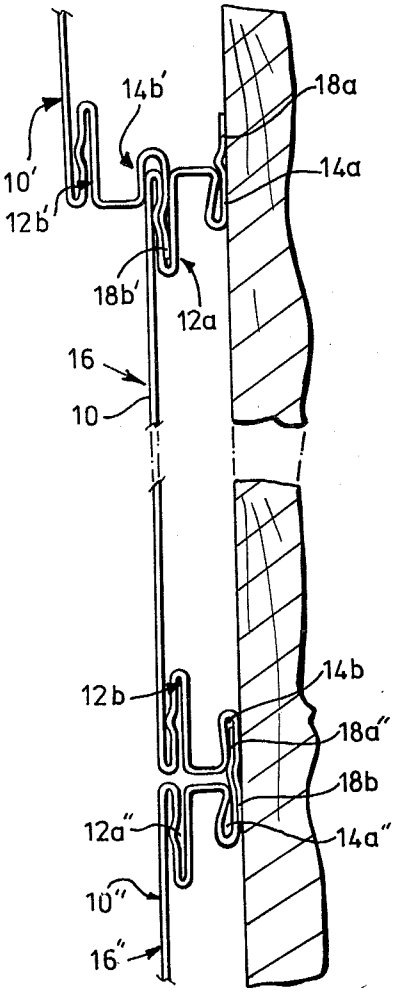
FIG. 1 is an end view of construction panels on a wall and showing an assembly both in the lap condition and in the flush condition.

Reference is now made to FIG. 1 which illustrates a panel 10 which is coupled at its upper extremity to a lower part of a panel 10' in a lapped condition and at its lower extremity to a panel 10'' in a flush condition. Parts of panels 10' and 10'' will be given respective primed and double primed numerals where they correspond with parts of panel 10. Similarly, because the marginal portions of the panels are similar, they will be differentiated by the suffix "a" for a top marginal portion as drawn and by the suffix "b" for a bottom marginal portion as drawn. This system will also be used in the other FIGS.

The panel 10 includes an outer channel **12*a* located between an inner channel 14*a* and a main portion 16 of the panel 10. Outer channel 12*a* is deeper than channel 14*a* to accommodate a tongue 18*b'* and to cause interengagement with channel 14*b'*. When this panel 10' is lapped relative to panel 10 a part of a front wall of channel 14*b'* is in face-to-face engagement with a part of the front face of main portion 16 of panel 10**. Consequently if for any reason the engagement between these panels is not complete, the appearance presented will not be affected.

At the lower portion of FIG. 1 an interlock between panels 10 and 10'' is shown. As seen in this figure the panels include deformations in the tongue **18*a''* channel 14*b* for a degree of locking engagement. Channels 12*b* etc. are also shaped to accomodate this locking engagement. Such an engagement is of course optional. It should also be noted that each of the channels 14*a* etc. are closed at their mouths to enhance the flush appearance in the flush condition. This is achieved because the result is to displace both main portions 16 and 16''** away from the building by the thickness of a tongue.

In the lapped condition shown in FIG. 1, the channel **12*b'* is evident after assembly and may be considered to detract from the overall lapped appearance. However this appearance can be improved by forming channels 12b' (and 12a) with a closed mouth like channel 14a**.

Figure 2:
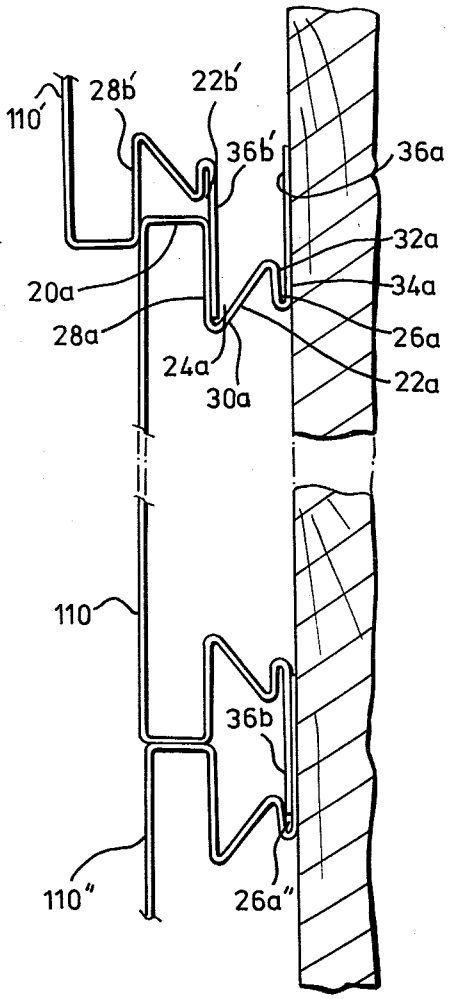
FIG. 2 is a view similar to FIG. 1 and showing another embodiment of construction panel which is also for use where both flush and lap requirements may be encountered.

An improvement over the FIG. 1 structure is shown in the embodiment illustrated in FIG. 2. This embodiment could be preferred where a anel is required both for overlap and flush conditions although in some instances the FIG. 3 panel may be preferred as will be explained.

For simplicity of description of FIG. 2 the numerals used with reference to FIG. 1 will be raised by one hundred where they correspond generally to those described with reference to FIG. 1. In FIG. 2 a panel 110 is interlocked with a panel 110' in the overlap condition and with a panel 110" in the flush condition. Panel 110 includes a marginal portion having a hand 20a which extends rearwardly terminating at a double channel section 22a defining a forward channel 24a and a shallower rearward channel 26a. The channel 24a is defined by a front wall 28a lying parallel to a main portion of the panel and an inclined rear wall 30a which extends to a point inwardly of the land 20a and meets a forward wall 32a of rearward channel 26a. This last wall is also parallel to the main portion of the panel and parallel to a rearward wall 34a which is extended outwardly to form a tongue 36a for attachment to the building.

The lapped interengagement between panel 110 and panel 110' is effected by engaging tongue 36b' in channel 24a so that the land 20a is contained in channel section 22b'. Panel 110' is located against outward movement by the tongue 36b' engaging wall 28a and inward movement is prevented by engagement of wall 28b' with the main portion of panel 110. The result is a positive connection giving the assembly an enhanced appearance. In the flush condition as illustrated by the interengagement of panel 110 and 110" the tongue 36b of panel 110 is engaged in channel 26a" and the walls of this channel prevent forward and rearward movement of panel 110.

The channels 26a etc. may also be closed to enhance the flush appearance after assembly in this condition in the manner of the channel 14a shown in FIG. 1.

Figure 3:
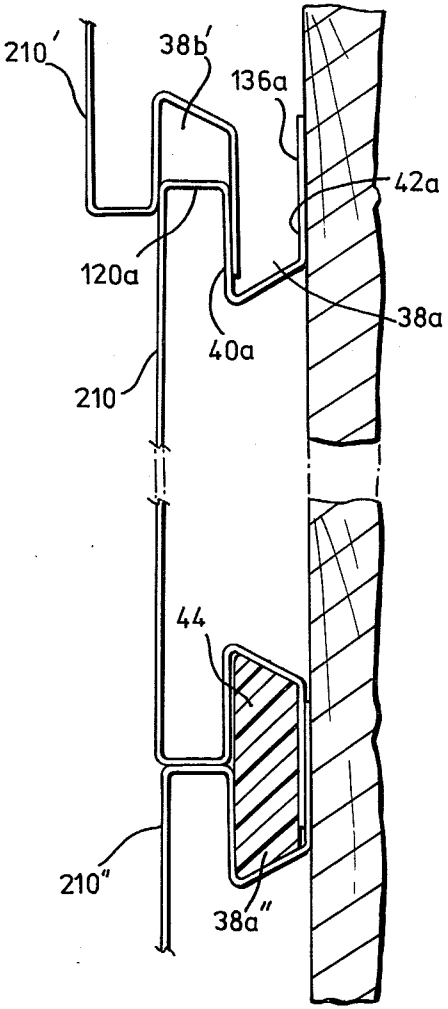
FIG. 3 illustrates a further embodiment suitable for use in both lap and flush conditions and including a spacer or filler in the flush condition.

The contour of the double channel section 22a described with reference to FIG. 2 can be simplified if a spacer or filler is used as illustrated in FIG. 3 and consequently this FIG. 3 embodiment may be preferred. This simplified contour requires a spacer strip or shorter spacer sections to positively locate the channels in the flush condition. Numerals indicating parts of the FIG. 3 embodiment corresponding to these described with reference to FIG. 1 will be raised by two hundred and by one hundred where they correspond to parts of the FIG. 2 embodiment.

A comparison of FIGS. 2 and 3 will indicate that in the overlap position the relationship between the panels 110 and 110' is similar to that between the panels 210 and 210'. The panel 210 defines a single channel 38a having respective front and rear walls 40a, and 42a and this rear wall extends into tongue 136a. Front wall 40a combines with the interengagement of land 120a in channel 38b' to locate panel 210' in the lapped condition. However, in the flush condition the panel 210 would not be located positively relative to the panel 210" without the use of a spacer or filler 44 which engages in adjacent channels between the panels thereby preventing outward movement of the panel 210 relative to the panel 210". The filler can be either a continuous strip or short pieces located at intervals along the panels and is preferably of a resilient material which will not deteriorate quickly. With proper proportioning the strip or filler will be a snug fit and tend to limit rattling noises and expansion creaking in the panels.

Further, if the strip is a close fit in channel 38a etc., then in the flush condition shown, the channel 38a" will be spread by the thickness of the tongue contained in the channel thereby making the front faces of adjacent panels coplanar.

Reference is finally made to FIG. 4 which illustrates an embodiment which would be preferable for use where only a lapped effect is desired. A first panel 310 is inter-engaged at a first marginal portion with a second panel 310' and at a second marginal portion with a third panel 310". The inter-engagement is similar to that used for the FIG. 3 embodiment but the panel 310 lacks structure necessary for inter-engagement in the flush condition. For ease of comparison parts corresponding generally with those described with reference to FIG. 3 will be given similar numerals but raised by one hundred. Such comparison will also show that this embodiment can be made for use in both lap and flush conditions by extending the flange.

Although many variations can be made to the shape of the marginal portions described with reference to the previous embodiments, the principle explained with reference to these structures should be maintained for adequate results. It will also be appreciated that changes can be made to alter the appearance. For instance the main portion of the panel could be formed or textured to change the overall appearance of the siding and also with suitable modification a trim or ventilating strip could be inserted between adjacent panels. This is particularly evident in the FIG. 3 embodiment in which the spacer or filler 44 could have an extension projecting between adjacent panels if such a trim strip is desired.

What I claim as my invention is:

1. A construction panel of relatively thin material for use with other such panels to selectively apply lapped and flush siding on a building structure, the panel being elongated with a substantially constant transverse cross-section and comprising:

a main portion having a front surface which is apparent after assembly on the building structure;

a first marginal portion extending generally rearwardly from a longitudinal side extremity of the main portion and defining a first land extending generally rearwardly from said side extremity, a channel immediately adjacent a rearward extremity of the land and proportioned such that the land of an adjacent panel can be contained in the channel to locate the adjacent panel, and a tongue lying rearwardly of and immediately adjacent the channel, the tongue being generally parallel to the main portion and projecting outwardly for use in attaching the panel to the building structure;

a second marginal portion also extending rearwardly and being connected to the main portion at a further longitudinal side extremity of the main portion such that the first and second marginal portions are generally parallel to one another, the second marginal portion being a mirror image of the first marginal portion and defining a second land, a second channel, and a second tongue, the respective channels also being adapted to receive tongues of other such panels to permit selective assembly either in the flush or lap arrangement, whereby in the lap arrangement one of the first and second channels receives a tongue of an adjacent panel with the land adjacent the channel positioned in the associated channel of the adjacent panel so that the thickness of the assembly is essentially twice the width of the land.

2. A construction panel for use with other such panels to selectively apply lapped and flush siding on a building structure, the panel comprising:

a generally planar main portion having a front surface which is apparant after assembly on the building structure; and first and second marginal portions having similar shapes in cross-section and being mirror images of one another, the marginal portions extending rearwardly at opposite longitudinal edges of the main portion, each of the marginal portions defining a pair of channels extending inwardly of the marginal portion in generally parallel arrangement with the main portion and a tongue spaced rearwardly of the channels and extending parallel to the main portion whereby this first panel can be selectively assembled with a similar second panel either in the lapped or flush conditions, the joints between panels in the lapped condition being formed by engaging a tongue of the first panel in the outer of the two channels of the second panel, and in the flush condition by engaging this tongue in the inner of these two channels.

3. An elongated construction panel having a substantially constant cross-section and comprising:

a main portion having a front face which is exposed on assembly of the panel on a building, the main portion having transverse extremities;

similar first and second marginal portions dependent from said respective transverse extremities of the main portion and extending longitudinally of the panel, these portions being mirror images of one another and extending generally rearwardly with respect to the main portion of the panel, each of the marginal portions defining a land extending rearwardly from the main portion;

each of said marginal portions defining engagement means engageable with other engagement means of another panel in a position in which the main portion and the main portion of said another panel are spaced generally parallel with one another, each of said marginal portions comprising a compound recess rearwardly of the land and extending inwardly, the recess having a forward wall lying generally parallel to the main portion, a forward portion, a rearward portion, and a flange for use in attaching the panel to a wall, whereby in said position, the land is contained in the compound recess of said another panel with the flange of this other panel in the forward portion of the compound recess of the first-mentioned panel and said front wall of such other panel in face-to-face relationship with the main portion of the first-mentioned panel, and in which the panel can be assembled with said another panel in another position where the flange is engaged in the rearward portion of the compound recess of said another panel so that the main portion of the panel is substantially coplanar with the main portion of said another panel.

4. An elongated construction panel having a substantially constant cross-section and comprising:

a main portion having a front face which is exposed on assembly of the panel on a building, the main portion having transverse extremities;

similar first and second marginal portions dependent from said respective transverse extremities of the main portion and extending longitudinally of the panel, these portions being mirror images of one another and extending generally rearwardly with respect to the main portion of the panel;

each of the marginal portions defining a land extending rearwardly from the main portion, and engagement means such that the engagement means of the panel are engageable with other engagement means of another panel in a position in which the main portion and the main portion of said another panel are spaced generally parallel with one another, the engagement means including a forward wall lying generally parallel to said main portion;

the first and second marginal portions further defining flanges adapted to attach the panel to a wall whereby in said position the land is engaged in the recess of said another panel with said forward wall in face-to-face relationship with the main portion of the panel, and in which the panel can be assembled in another position where the flange is engaged in the recess of said another panel so that the main portion is coplanar with the main portion of said another panel.

5. An elongated construction panel as claimed in claim 4 in which the engagement means further includes a further recess spaced rearwardly of the first recess to provide an alternative assembly in said another position whereby said further recess receives said flange.

6. A construction panel as claimed in claim 1 in which the tongue extends outwardly beyond the first land so that in the flush condition one of the first and second channels receives the tongue of the adjacent panel with this channel aligned with a channel of the adjacent panel.

7. A construction panel of sheet material for use with other such panels to selectively apply lapped and flush siding on a building structure, the panel being elongated with a substantially constant transverse cross-section and comprising:

a main portion having a front surface which is apparent after assembly on the building structure;

a first marginal portion extending generally rearwardly from a longitudinal side extremity of the main portion and defining a first land extending generally inwardly and rearwardly from said side extremity, a channel immediately adjacent a rearward extremity of the land and having a bottom wall extending generally outwardly and rearwardly, and a tongue extending outwardly terminating level with the side extremity of the main portion, the channel being proportioned so that the land of an adjacent panel can be contained in the channel with this land in fact-to-face engagement with said bottom wall to locate the adjacent panel;

a second marginal portion also extending rearwardly and being connected to the main portion at a further longitudinal side extremity of the main portion such that the first and second marginal portions are generally parallel to one another, the second marginal portion being a mirror image of the first marginal portion and defining a second land, and a second channel, the respective channels also being adapted to receive tongues of other such panels to permit assembly in the lap arrangement, whereby one of the first and second channels receives a tongue of an adjacent panel with the land of the adjacent panel in face-to-face engagement with said bottom wall so that the thickness of the assembly is essentially three times the width of the land.

* * * * *